United States Patent [19]

Kelly

[11] 3,995,115

[45] Nov. 30, 1976

[54] SPEECH PRIVACY SYSTEM

[75] Inventor: James M. Kelly, Holmdel, N.J.

[73] Assignee: Bell Telephone Laboratories, Incorporated, Murray Hill, N.J.

[22] Filed: Aug. 25, 1967

[21] Appl. No.: 663,307

[52] U.S. Cl. ..... 179/1.5 S; 179/1.5 R

[51] Int. Cl.[2] ..... H04K 1/04

[58] Field of Search ..... 179/1.5, 1.5 R

[56] References Cited

UNITED STATES PATENTS 3,341,659 9/1967 Stern ..... 179/1.5 R

*Primary Examiner*—Howard A. Birmiel

*Attorney, Agent, or Firm*—G. E. Murphy

[57] ABSTRACT

The communication of confidential information is generally accomplished by transforming applied message waves into an unintelligible form prior to transmission. Such a transformation may be accomplished by scrambling the applied message waves in either the frequency or time domain. Scrambling, per se, does not render a signal satisfactorily unintelligible. In order to overcome this deficiency, scrambling techniques are utilized jointly with vocoder and selective speech processing methods. In a voice-excited vocoder, the spectrum channel control signals are scrambled in the frequency domain and the baseband signal is severely center clipped in order to enhance unintelligibility. A high degree of privacy during transmission is thus obtained with negligible effect upon the quality or intelligibility of speech synthesized by an authorized recipient.

7 Claims, 2 Drawing Figures

INVENTOR
J. M. KELLY
BY
G. E. Hirsch Jr.
ATTORNEY

SPEECH PRIVACY SYSTEM

BACKGROUND OF THE INVENTION

1. Field of the Invention

This invention pertains to communication systems and, more particularly, to communications systems wherein a signal is rendered unintelligible during transmission in order to insure privacy.

The communication of confidential information is generally accomplished by providing, at each terminal station of a system, suitable equipment for transforming applied message waves into an unintelligible form before transmission over the medium connecting the terminal stations. Unauthorized personnel are therefore prevented from detecting transmitted signals and thereby obtaining an understanding of the information transmitted.

2. Description of the Prior Art

Diverse systems have been devised in which electrical signals corresponding to speech or other signals, to be privately transmitted, have been rendered unintelligible. For example, speech signals have been "scrambled," or "garbled," in the time or frequency domain or both; their frequency components have been inverted with respect to a selected nominal frequency or such signals have been broken up into segments which are then transmitted in alternation with corresponding segments of another message.

Time scrambling, i.e., garbling a signal in the time domain, usually introduces an excessive amount of transmission delay and discontinuities in the scrambled signal which result in an intolerable level of noise in the recovered signal. Systems which scramble in both time and frequency, simultaneously, generally suffer from the same detrimental behavior. Frequency scrambling systems, on the other hand, have negligible transmission delay and a greatly improved recovered quality. However, such systems, in order to attain a high degree of privacy, have relied upon complicated and intricate arrangements of apparatus and equipment. The cost and complexity of such equipment has therefore rendered it substantially impractical for use in a commercial environment, where lost cost and small weight and size are essential.

SUMMARY OF THE INVENTION

It is, therefore, an object of this invention to improve the performance of privacy communication systems.

Another object of this invention is to attain a high degree of privacy in a communication system without resort to complex and expensive equipment.

In accordance with the principles of this invention, these and other objects are accomplished by the joint utilization of vocoder techniques and selective speech processing methods. More particularly, in a voice-excited vocoder, the spectrum channel signals, i.e., reduced bandwidth control signals, are scrambled in the frequency domain. Any residual intelligibility of the resulting scrambled signals, due to long term speech energy distributions, is removed by pre-emphasizing the speech signal. A fortuitous side effect of pre-emphasizing the input signal is a reduction in the average amount of spectrum channel crosstalk.

In order to render the baseband signal of the voice-excited vocoder unintelligible during transmission, the baseband signal is severely center clipped. Any residual intelligibility is eliminated by the substitution, during unvoiced and silent periods of speech, of noise signals for the baseband signal.

A high degree of unintelligibility during transmission is obtained with negligible effect upon the quality or intelligibility of the reproduced synthesized speech.

At an authorized receiver station the control signals are unscrambled and a group of excitation signals are developed from the center clipped baseband signal. The unscrambled control signals alter the amplitudes of the excitation signals, and the altered signals are utilized to reconstruct the original speech signal.

These and further features and objects of this invention, its nature and various advantages, may be more fully understood by reference to the appended drawings.

DETAILED DESCRIPTION OF THE INVENTION

Figure 1:
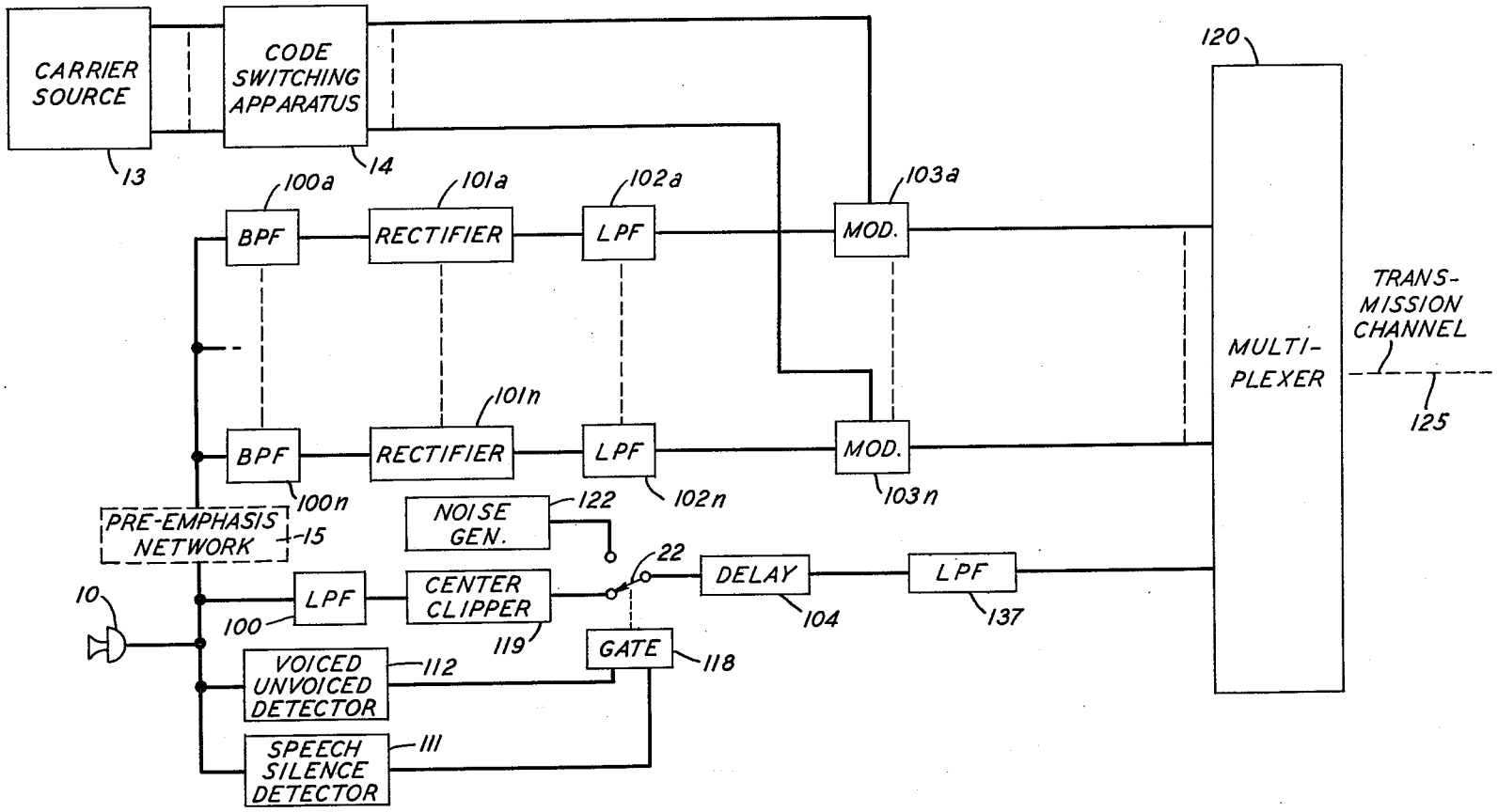
FIG. 1 illustrates a speech transmitter used in the communication privacy system of the instant invention.

In the speech transmitter or analyzer of FIG. 1, there is shown a source of telephone quality speech signals, for example, a telephone transmitter 10, which may be of any conventional construction. A band limited speech signal, originating in the telephone transmitter, is applied in parallel to low-pass filter 100 and to bandpass filters 100*a* through 100*n*. The speech signal may be pre-emphasized in order to equalize the long time energy in each channel, 100*a* through 100*n*, as will be more fully described hereinafter. The passbands of filter 100 and filers 100*a* through 100*n* are chosen to divide the speech signal into a relatively narrow band of low frequency components and a plurality of relatively narrow contiguous speech band components, respectively. The lower limit of the narrow band of low-frequency components, or baseband, is set at the highest low-frequency cut-off point of commercial telephone circuits, approximately 250 cycles per second. The upper limit is set at a frequency that will insure that the baseband contains accurate information regarding the fundamental pitch frequency of a wide range of typical human voices; for example, the upper limit is set at about 1500 cycles per second. The other relatively wide band of frequency components extends from 250 cycles per second to the upper limit of the band limited speech signal, approximately 3,500 cycles per second. Filters 100*a* through 100*n* subdivide this relatively wide band into a number of contiguous subbands whose bandwidths are sufficiently small to define, with accuracy, the individual frequency components of the speech signal; for example, the contiguous subbands from 250 cycles per second to approximately 1,900 cycles per second may have bandwidths of 150 cycles per second while the contiguous subbands from 1,900 cycles per second to 3,500 cycles per second may have somewhat broader bandwidths to produce a total of approximately $n = 15$ subbands.

To the output terminal of each bandpass filter, 100*a* through 100*n*, there is connected a rectifier, 101*a* through 100*n*, preferably full wave, followed by a low-pass filter 102*a* through 102*n*. The cut-off frequency of each low-pass filter is about 20 cycles per second. The output signal of each low-pass filter is a reduced bandwidth control signal whose instantaneous magnitude is representative of the instantneous amplitudes of the components in its associated subband. The total bandwidth of the baseband and the reduced bandwidth control signals may be approximately equal to the bandwidth of the original signal of telephone transmitter 10. Some bandwidth reduction is possible, but at the expense of recovered quality of the reproduced speech signal.

In order to render the speech signal unintelligible during transmission, the baseband signal developed by low-pass filter 100 and the reduced bandwidth control signals developed at the output of filters 102 must be processed prior to transmission.

Accordingly, the reduced bandwidth control signals are applied to modulators 103*a* through 103*n* wherein they are "scrambled" in the frequency domain, responsive to signals emanating from code switching apparatus 14. Apparatus 14 may be any one of a plurality of devices known to those skilled in the art; see for example, U.S. Pat. No. 2,424,998, issued to H. Nyquist on Aug. 5, 1974. Code switching apparatus 14 selectively applies, in accordance with a predetermined code format, a plurality of carrier wave signals, emanating from source apparatus 13, to modulators 103. Thus, the control signals during different intervals of time, established by the code format, are modulated by diverse carrier signals. The modulated, frequency scrambled control signals exhibit no particular discernible pattern. with the exception of long time speech energy distributions. Privacy is thus achieved by modulating the spectrum channel energy signals, i.e., the control signals, by a series of vaccillating carrier signals.

In order to overcome any residual intelligibility which may be present on a long term basis, the speech signals from transmitter 10 may be processed by a pre-emphasis network 15, prior to development of the control signals. Pre-emphasis results in a long time energy distribution that presents very little information concerning the code used. A fortuitous side effect of pre-emphasizing the input speech is a reduction in the average amount of spectrum channel crosstalk. Conventionaly, frequency multiplexed vocoders transmit the spectrum signals in order. Thus, the amount of energy in each carrrier is strongly correlated with the amount of energy in adjacent carriers. Transmitting the spectrum signals in scrambled order removes this correlation and effectively increases the amount of crosstalk. Pre-emphasizing the input speech tends to force all carriers to have the same average energy and thereby reduce the average amount of crosstalk.

Thus, having rendered the spectrum channel signals substantially unintelligible, it is necessary, also, to process the baseband signal in order to insure complete privacy.

Modification of the baseband signal, appearing at the output of filter 100, in order to insure unintelligibility during transmission, is achieved by the use of center clipper 119. Clipper 119, which may be of the type described in the copending application of M. M. Sondhi, filed June 1, 1965 now U.S. Pat. No. 3,381,091, which issued on Apr. 30, 1968, serves to eliminate certain oscillations which fall below a pre-established clipping level. The clipping level is set at a predetermined percentage, for example 75 per cent, of the maximum absolute values of the baseband signal within a specified time interval, for example, 15 milliseconds. By dividing the speech baseband signal into relatively short successive time intervals of speech duration, a clipping level will be established whose value fluctuates with naturally occurring variations in the speech level. In this manner, the clipping level is automatically adjusted so that the same relative portion of the speech wave is removed during each time interval. Hence, speech signals having an absolute value less than the established clipping level are clamped to zero while speech levels greater than the established clipping level are reduced by an amount equal to the clipping level. The effect of center clipping is to delete the middle amplitude band of the applied speech wave with the meritorious effects of flattening the spectral energy distribution and removing from the speech signal most of its intelligibility. A high degree of unintelligibility during transmission is thus obtained with negligible effect upon the quality or intelligibility of the reproduced synthesized speech. Indeed, it has been found that even more severe forms of clipping further improve the operation of the instant invention. Thus, instead of center clipping, i.e., retaining peaks of both polarity of an applied signal which exceed a predetermined level, half wave clipping, i.e., retaining peaks of only one polarily, may be used, if so desired.

The recovered quality off the synthesized speech is highly dependent upon the clipping level. Clipping levels substantially larger than 75 per cent significantly degrade the quality of the recovered speech. The perceptible effect of high clipping levels is a noticeable absence of the excitation signal at the synthesizer of FIG. 2 during certain voiced intervals of the speech. On the other hand, a clipping level established at approximately 75 per cent does not remove all intelligibility; the residual intelligibility, although quite low, enables one to obtain some contextual information. It has been found, however, that deletion of the baseband signal during unvoiced intervals of speech and during silent periods of speech and the insertion of noise during these intervals eliminates substantially all residual intelligibility. The effect of substituting noise during unvoiced and silent intervals of speech, on the quality of the recovered speech, is negligible.

Thus, the speech signals emanating from telephone transmitter 10 are also applied in parallel to a voiced-unvoiced detector 112 and speech silence detector 111. Detectors 111 and 112 may be conventional apparatus well known to those skilled in the art. Upon the presence of a signal at the output of either detector, 111 or 112, indicating an unvoiced or silent interval of speech, OR gate 118 is activated which in turn operates switch 22. Switch 22, in its normal operative position, connects the output of center clipper 119 to the input of delay element 104. Upon actuation of switch 22, by a signal emanating from OR gate 118, the output signals of noice generator 122 are substitued for the signals of clipper 119. Noise generator 122 is thus connected to delay element 104 instead of center clipper 119. The substitution of noise signals from generator 122 during unvoiced and silent intervals of speech eliminates any residual intelligibility in the transmitted baseband signal.

By suitably multiplexing the ceter clipped baseband signal and the scramble control signals in a conventional multiplexer 120, the speech signal originating in transmitter 10 may be transmitted, in modified form, over a reduced bandwidth transmission channel 125, as indicated in FIG. 1. Before multiplexing, however, the clipped baseband output of clipper 119 or the noise signals of generator 122 are passed through a conventional delay element, illustrated by element 104 of FIG. 1, to compensate, as required, for the delay introduced by low-pass filters, 102*a* through 102*n*, in deriving the group of reduced bandwidth control signals. Low-pass filter 137 removes undesired harmonics of the center clipped signal. Of course, multiplexing need not be used; any other method or mode of transmision is suitable.

Figure 2:
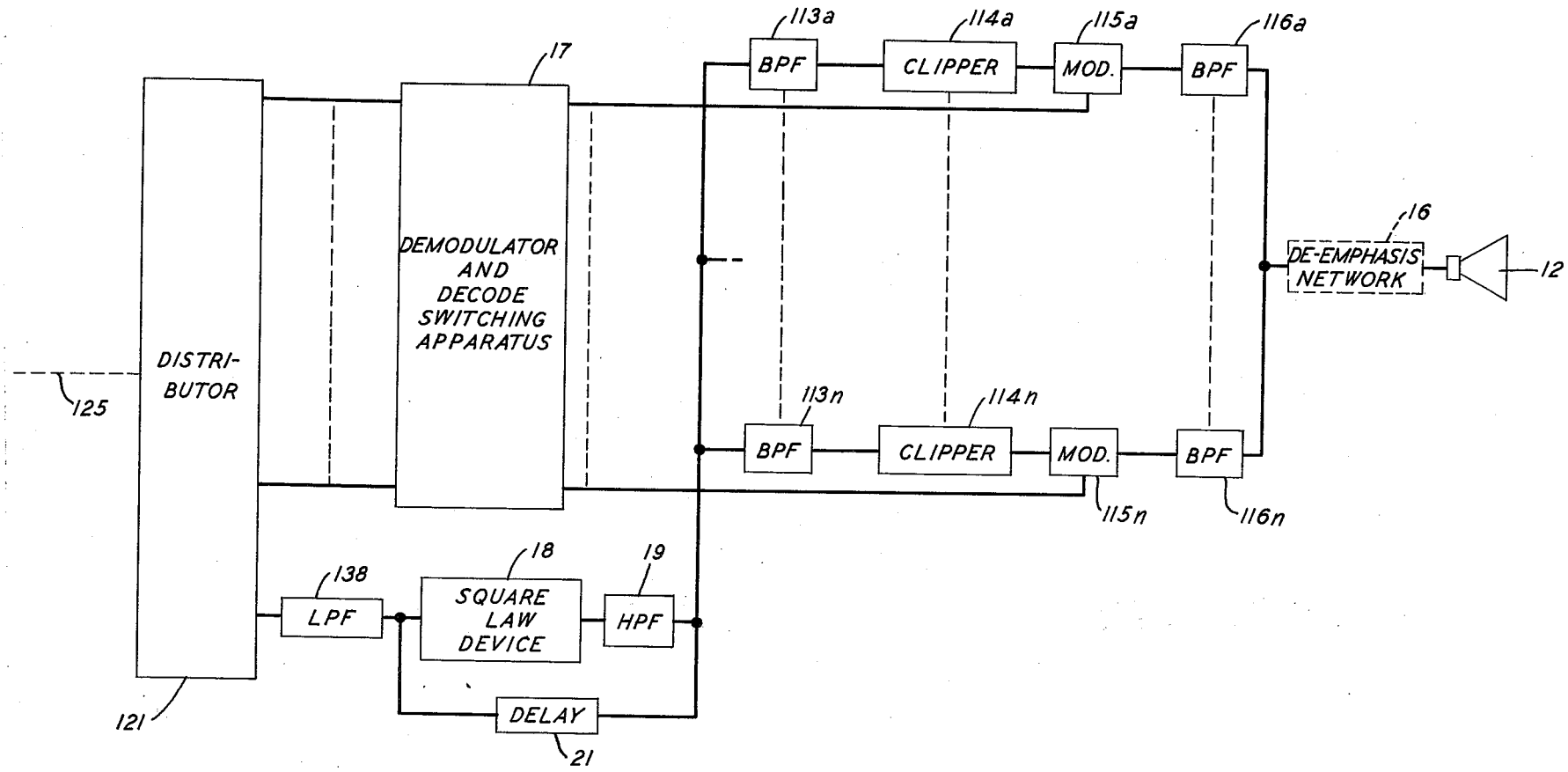
FIG. 2 illustrates a speech receiver used in the system of this invention.

At an authorized receiver synthesizer station of FIG. 2, multiplexed signals, received over transmission channel 125, are separated by a suitable distributor 121, and the spectrum channel control signals are applied to demodulator and decode switching apparatus 17. To derive the group of excitation signals, the clipped baseband signal is passed through low-pass filter 138, square law device 18, of conventional construction, and high-pass filter 19 which has a low frequency cutoff of approximately 1,500 cycles per second. Device 18 generates higher order harmonics of the fundamental speech frequency from the baseband of low-frequency components passed by filter 138 and filter 19 deletes any baseband components remaining which may be distorted by device 18. Undistorted baseband components are resupplied via delay network 21, which compensates for any delay in devices 18 and 19. Thus the higher order harmonics and the original clipped baseband signal are combined to develop and excitation signal for the synthesizing channels of the receiver of FIG. 2.

The derived excitation signal is applied in parallel to a bank of bandpass filters 113*a* through 113*n*, whose passbands are identical with the passbands of filters 100*a* through 100*n* of FIG. 1. Filters 113*a* through 113*n* divide the spectrum of the excitation signal into subbands identical in frequency with the subbands into which the band of frequency components is subdivided at the transmitter station. Each subband of signals from filters 113*a* through 113*n* is passed to an infinite clipper 114*a* through 114*n*, respectively, and each infinite clipper, which may be of any desired sort, generates from the components of each subband an excitation function for the reconstruction of one of the subbands of frequency components of the original speech signal. Each excitation signal is applied to the input terminal of one of the conventional modulators, 115*a* through 115*n*, and each of the reduced bandwidth control signals from apparatus 17 is applied to the control terminal of one of the modulators.

Demodulator and decode switching apparatus 17 performs two functions: the modulated carrier signals are unscrambled in accordance with the same code format utilized in apparatus 14 of FIG. 1 and the unscrambled modulated control signals are demodulated, i.e., the carrier signals introduced by modulators 103*a* through 103*n* of FIG. 1 are eliminated. Thus, the signals appearing at the output of apparatus 17 correspond to the same spectrum energy control signals that appear at the output of filters 102*a* through 102*n* of the transmitter analyzer. These control signals, applied to the terminals of modulators 115*a* through 115*n* adjust the amplitudes of the excitation signals and the amplitude adjusted excitation signals are filtered by baseband filters 116*a* through 116*n*. Filters 116 have passbands identical with filters 100*a* through 100*n* of the analyzer and are utilized to reconstruct the frequency subbands of the original speech signal.

A replica of the original speech signal is synthesized by combining the reconstructed high-frequency subbands at the output of filters 116*a* through 116*n*.

When a pre-emphasis network 15 is used at the analyzer of FIG. 1 to equalize the long time energy in each speech channel, a counterpart de-emphasis network 16, also of conventional construction, must be used at synthesizer 11 to redistribute the speech energy in accordance with its original distribution.

The synthesized speech is converted into highly intelligible, natural sounding speech by reproducer 12, for example, a conventional telephone receiver.

It is to be understood that the above-described arrangements are merely illustrative of applications of the principles of the invention. Numerous other arrangements may be devised by those skilled in the art without departing from the spirit and scope of the invention. For example, frequency inversion and other well-known techniques for rendering a signal unintelligible may be employed in lieu of or in addition to the frequency scrambling apparatus illustrated.

What is claimed is:

1. Speech privacy transmitter apparatus comprising:
a source of speech signal,
means for developing a plurality of reduced bandwidth control signals whose instantaneous magnitudes are proportional to the instantaneous amplitudes of the components, respectively, within each of a plurality of predetermined frequency subbands of said speech signal,
means for extracting from said speech signals a signal representative of the baseband components of said speech signal,
means for rendering said plurality of reduced bandwidth control signals unintelligible prior to transmission,
means for rendering said representative baseband signal unintelligible prior to transmission,
and means for transmitting said signals which have been rendered unintelligible.

2. Speech privacy transmitter apparatus as defined in claim 1 wherein said means for rendering said plurality of reduced bandwidth control signals unintelligible comprises:
a source of a plurality of carrier wave signals,
and means for modulating said reduced bandwidth control signals with said carrier wave signals in accordance with a predetermined format.

3. Speech privacy transmitter apparatus as defined in claim 1 wherein said means for rendering said representative baseband signal unintelligible comprises:
means for amplitude clipping said baseband signal.

4. Apparatus for rendering an applied speech signal unintelligible to unauthorized personnel comprising:
vocoder means for generating from said applied speech signal a plurality of spectrum channel control signals and a baseband signal,
means for modulating in accordance with a predetermined code format said spectrum channel control signals with a plurality of carrier wave signals,
and means for center clipping said baseband signal.

5. Apparatus for rendering an applied speech signal unintelligible to unauthorized personnel comprising:
vocoder means for generating from said applied speech signal a plurality of spectrum channel control signals and a baseband signal, means for modulating in accordance with a predetermined code format said spectrum channel control signals with a plurality of carrier wave signals, means for center clipping said baseband signal, and means for substituting during unvoiced and silent intervals of said speech signal noise signals for said center clipped baseband signal.

6. A speech privacy system comprising:

a source of speech signals, vocoder analyzer means for generating from said speech signals a plurality of reduced bandwidth control signals and a representative baseband signal, means for frequency scrambling said reduced bandwidth control signals, means for center clipping said baseband signal, means for replacing said center clipped baseband signal with noise signals during unvoided and silent intervals of said speech signals, means for transmitting said frequency scrambled control signals and said center clipped baseband signal or said noise signals in replacement thereof, means for receiving said transmitted signals, means for unscrambling said received frequency scrambled reduced bandwidth control signals, means for processing said received baseband signal to develop a plurality of excitation signals, and vocoder synthesizer means responsive to said unscrambled reduced bandwidth control signals and said excitation signals for reproducing an intelligible replica of said speech signals.

7. The method of rendering a transmitted speech signal unintelligible to unauthorized personnel comprising the steps of:

generating from an applied speech signal a plurality of reduced bandwidth control signals and a baseband signal, modulating said control signals with a plurality of carrier wave signals in accordance with a predetermined format, and center clipping said baseband signal.

* * * * *